United States Patent [19]

Bacon

[11] Patent Number: 4,559,754

[45] Date of Patent: Dec. 24, 1985

[54] INSPECTION AND REJECTION APPARATUS

[75] Inventor: Forrest C. Bacon, Inver Grove Heights, Minn.

[73] Assignee: Ex-Cell-O Corporation, Troy, Mich.

[21] Appl. No.: 691,100

[22] Filed: Jan. 14, 1985

[51] Int. Cl.[4] ..... B07C 5/02

[52] U.S. Cl. ..... 53/53; 53/138 A

[58] Field of Search ..... 53/53, 54, 138 A, 76, 53/75; 209/597

[56] References Cited

U.S. PATENT DOCUMENTS

| | | | |
|---|---|---|---|
| 2,991,879 | 7/1961 | Innocenti | 53/53 X |
| 3,606,014 | 9/1971 | Linn | 53/53 X |
| 3,939,984 | 2/1976 | Butner et al. | 53/53 X |
| 4,011,155 | 3/1977 | Feurstein et al. | 53/53 X |
| 4,349,998 | 9/1982 | Covert | 53/53 |

*Primary Examiner*—James F. Coan

*Attorney, Agent, or Firm*—John P. Moran

[57] ABSTRACT

The drawings and description discloses an inspection and rejection mechanism for wrapped loaves of bread having one end thereof tied. The mechanism includes vacuum means for straightening out tied ends, in conjunction with suitable photo-electric means for detecting the absence of a tied end, or the presence of an open untied end, or the presence of two adjacent ends tied together. If any of the latter conditions exist, after two indexes a pusher device causes two loaves to be pushed to one side, rather than being fed through to discharge.

5 Claims, 1 Drawing Figure

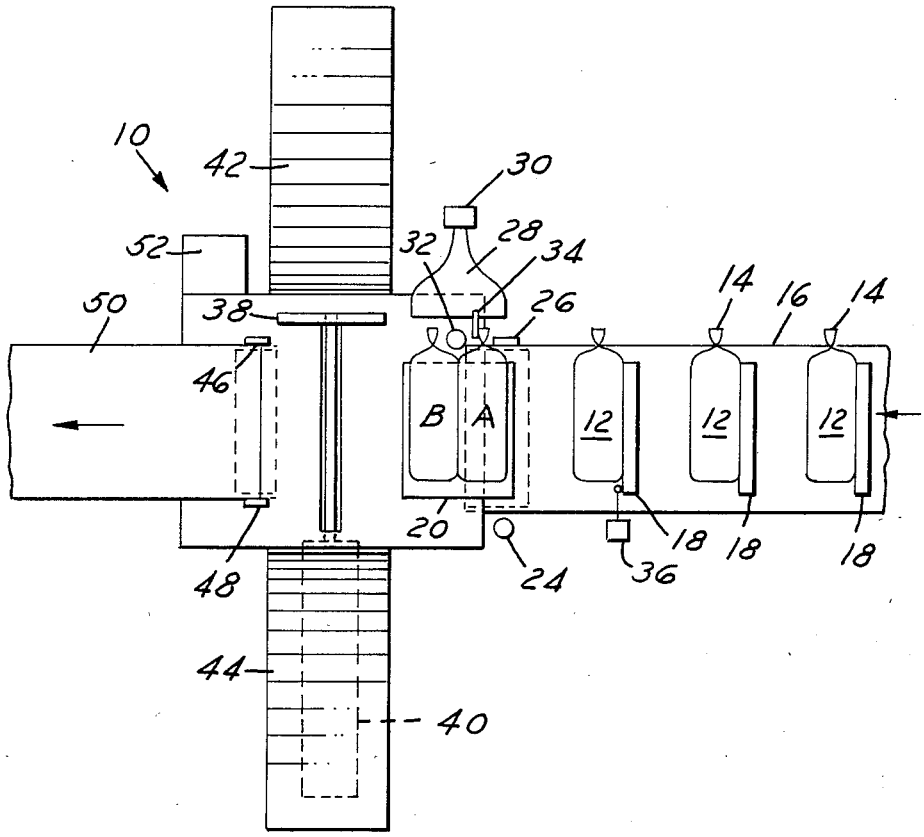
10
42
30
52
32
28
34
14
16
14
50
38
26
46
B
A
12
12
12
20
18
18
18
48
24
36
44
40

INSPECTION AND REJECTION APPARATUS

TECHNICAL FIELD

This invention relates generally to inspection equipment and, more specifically, to an inspection apparatus for inspecting loaves of wrapped bread, tied at one end thereof, and rejecting those loaves having either no wrapping or no tie, or having improperly tied ends.

BACKGROUND ART

Heretofor, insofar as is known, wrapped loaves of bread with one end thereof tied have been manually inspected and rejected if not tied or tied incorrectly by a wrapping machine. It is desirable to have such inspection handled automatically with automatic means for discharging unacceptable loaves.

DISCLOSURE OF THE INVENTION

Accordingly, an object of the invention is to provide improved automatic means for inspecting wrapped loaves of bread, or similar baked products, which have one end thereof tied.

Another object of the invention is to provide an inspection apparatus for inspecting the tied ends of wrapped loaves of bread, and rejecting those loaves having either no wrapper, or untied or improperly tied ends.

A further object of the invention is to provide an inspection apparatus for wrapped and tied loaves of bread, including switch means for noting the presence of loaves, vacuum means for straightening out the individual tails of the loaves, and a photo-electric means for detecting tied ends and signalling a cylinder-actuated pusher plate to reject any improperly tied loaves.

These and other objects and advantages of the invention will be more apparent when reference is made to the following drawings and accompanying description.

BRIEF DESCRIPTION OF THE DRAWINGS

The FIGURE is a schematic plan view representation of the invention.

BEST MODE OF CARRYING OUT THE INVENTION

Referring now to the drawing in greater detail, there is illustrated a loaf reject mechanism 10 for rejecting loaves of bread 12 which are either not wrapped or have untied or improperly tied ends 14, operating in conjunction with an indexing conveyor 16 conveying loaves of bread.

The conveyor 16 includes equally spaced flight bars 18 secured along said conveyor for carrying a loaf of bread adjacent each flight bar from a bread wrapping device (not shown).

The loaf reject mechanism 10 includes a plate member 20 mounted intermediate the discharge end of the conveyor 16 and a table 22, approximately as wide as two loaves of bread. Suitable switch means, such as a photo-electric unit 24 is mounted adjacent the left front corner (FIG. 1) of the plate member 20. An air nozzle 26 is mounted adjacent the other front corner of the plate member 20, pointing to the left in FIG. 1 for a purpose to be described. A vacuum head 28 is mounted adjacent a side edge of the plate member 20, beyond the air nozzle 26. A source of vacuum 30 is operatively connected to the vacuum head 28. The loaves 12 are conveyed from a conventional bread wrapping machine (not shown) with the tied ends 14 pointing toward the side on which the vacuum head is mounted. A photo-electric unit 32 is mounted between the vacuum head 28 and the side edge of the plate member 20, at a point midway between the conveyor or front edge thereof and the table or rear edge thereof, aimed upwardly. A tied end restraint bar 34 is mounted between the vacuum head 28 and the photo-electric unit 32, just in front of the latter and in the path of oncoming tied ends. A limit switch 36 is mounted along the conveyor 16 so as to be actuated by each flight bar 18.

A pusher plate 38, approximately the width of two loaves extends downwardly from a suitable overhead-mounted cylinder unit, represented at 40, so as to be moveable laterally across the table 22 once the cylinder unit 40 receives a signal from the photo-electric unit 32, as will be explained. A pair of chutes 42 and 44 are mounted on opposite sides of the table 22 such that, as the pusher plate 38 reciprocates therebetween, any rejected loaves of bread are pushed into one or the other of the chutes. A pair of rearwardly pointing air nozzles 46 and 48 are located on the table 22 such that they are aimed across the path of the pusher 38.

A discharge conveyor 50 is mounted adjacent the end of the table 22 opposite the plate member 20, for receiving the loaves of bread which are properly wrapped and tied, as they are pushed forward by the oncoming loaves.

A control panel 52, which may be mounted in any suitable location, contains suitable electrical and timing components (not shown) for actuation of the photo-electric units 24 and 32, the limit switch 36, and the cylinder unit 40.

OPERATION

Consider first successive loaves of bread 12 which are properly wrapped and tied. Such loaves will pass by the photo-electric unit 24, indicating the entering of successive loaves onto the plate member 20 area where inspection thereof will occur. Each loaf will thereupon be pushed from the first position A on the plate member by the succeeding loaf onto the second position B on the plate member, passing the photo-electric unit 32. While moving from position A to position B, the tail end 14 of each loaf will be drawn to its full length by the vacuum head 28. The bar 34 serves to retard and straighten out the tied end of the loaf A such that, as the loaf A begins to move, the air nozzle 26 serves to narrow-up a properly tied end so as to not obstruct the photo-electric unit 32, and then causes the tied end to snap past the bar 34 and, hence, past the photo-electric unit 32 to complete the inspection process. The beam of the photo-electric unit 32 will have been broken instantaneously signifying that properly tied tails 14 have passed by, thereby permitting the loaves to be pushed across the table 22 to the discharge conveyor 50.

Consider next the passage of an unwrapped loaf of bread 12 from position A to position B. There will have been a signal from the limit switch 24, with no follow-up signal from the photo-electric unit 32. This will cause the cylinder unit 40 to be actuated after two more indexes, as indicated by the photo-electric unit 36, to cause the pusher plate 38 to make a lateral stroke in one direction across the table 22, pushing two loaves into one of the chutes 42 or 44. The pusher plate will remain in this new position until the cylinder unit 40 is once again actuated.

Consider now the passage of an untied loaf of bread 12 from position A to position B. The vacuum head 28 will have drawn the open end of the bread wrapper into its widest opening, causing it to continue to block the beam of the photo-electric unit 32 while in each of the positions A and B and therebetween. This will set up the cylinder unit 40 to move the pusher plate 38 back across the table 22 after two indexes, indicated by the photo-electric unit 36, to push two loaves into the other of the chutes 42 or 44, while the air nozzles 46 and 48 blow against the adjacent side of the laterally moving loaf B to help the pair of loaves to maintain a lengthwise or longitudinal attitude while being pushed across the table 22 toward the chutes.

Consider last the passage of two loaves of bread 12 having their ends erroneously tied together. This combination of tied ends 14 would cause the beam of the photo-electric unit 32 to be blocked while the two loaves are in positions A and B, once again setting up the cylinder unit 40 to cause the two tied-together loaves to be pushed off the table 22 after two indexes.

INDUSTRIAL APPLICABILITY

It should be apparent that the invention provides an efficient, automatic means for a bakery to be assured that all loaves of bread, or other wrapped and tied bakery products, which are discharged for shipment are properly wrapped and tied, eliminating the need for manual inspection thereof.

While but one embodiment of the invention has been shown and described, other modifications thereof are possible.

The embodiments of the invention in which an exclusive property or privilege is claimed are defined as follows:

1. An inspection and rejection mechanism comprising a conveyor having equally spaced flight bars secured thereon for carrying loaves of bread, each intended to have a wrapper with one tied end thereon, a plate member mounted with its front edge at the discharge end of said conveyor and having a width suitable for first and second loaf positions, a vacuum head mounted adjacent one side edge of said flat plate for pulling each tied end into an elongated shape, a reciprocally mounted pusher plate mounted on a table just beyond the back edge of said plate member, a chute mounted on at least one side of said table, switch means mounted adjacent the front edge of said plate member for indicating the passage therepast of successive loaves, and a photo-electric unit mounted between the vacuum head and said side edge of said plate member at the midpoint therealong, said photo-electric unit serving, if not broken, to indicate the absence of a tied end moving from the first position to the second position on said plate member, and if the break is prolonged after a loaf passes from the first to the second position, to indicate that the end is not tied or that two adjacent ends are tied together, and, hence, to signal said pusher plate to move across said table to reject two loaves into said chute.

2. A wrapped loaf of bread inspection and rejection mechanism comprising an indexing conveyor for carrying loaves of bread, each intended to have a wrapper with one tied end thereon; an inspection station including a plate approximately the width of two loaves mounted at the discharge end of said conveyor, a vacuum head mounted adjacent one side edge of said plate for pulling the tied end into an elongated shape, a source of vacuum operatively connected to said vacuum head, a first photo-electric unit mounted adjacent the front edge of said plate, and a second photo-electric unit mounted between the vacuum head and said side edge of said plate at the midpoint therealong; and a rejection station including a reciprocally mounted pusher plate mounted on a table just beyond the back edge of said plate, switch means mounted along said indexing conveyor for detecting each index thereof, and a chute mounted at each side of said table in line with the path of said pusher plate, said photo-electric unit serving, if not broken, to indicate the absence of a tied end on a loaf of bread moving from the first position to the second position across said plate, and if the break is prolonged after a loaf passes from the first to the second positions, to indicate that the end is not tied or that two adjacent ends are tied together, and, hence, to signal said pusher plate to move across said table after two indexes, as identified by the actuation of said switch means by two successive conveyor indexes, to reject two loaves at a time into one of said chutes.

3. The inspection and rejection mechanism described in claim 2, and a pair of air nozzles mounted so as to provide air blasts across the path of said pusher plate to retain said loaves in a longitudinal attitude while being pushed off said table by said pusher plate.

4. The inspection and rejection mechanism described in claim 2, and an air nozzle located adjacent said one side edge of said plate so as to provide air blasts rearwardly along the path of said tied ends to assist the action of said vacuum head.

5. The inspection and rejection mechanism described in claim 4, and a tied end restraint bar for cooperating with said air nozzle to cause each tied end to snap quickly past said photo-electric unit as it passes from the first to the second positions on said plate.

* * * * *